United States Patent [19]

Britt et al.

[11] Patent Number: 4,754,898

[45] Date of Patent: Jul. 5, 1988

[54] MULTI-ORIFICE DISPENSING CLOSURE

[75] Inventors: William J. Britt, Greenville; Scott A. Silvenis, Mauldin, both of S.C.

[73] Assignee: The Dow Chemical Company, Midland, Mich.

[21] Appl. No.: 766,455

[22] Filed: Aug. 16, 1985

[51] Int. Cl.[4] ..... B65D 51/18

[52] U.S. Cl. ..... 222/487; 222/482; 220/255

[58] Field of Search ..... 222/478, 482–484, 222/487, 481; 220/255, 339; 215/235

[56] References Cited

U.S. PATENT DOCUMENTS

| | | | |
|---|---|---|---|
| D. 244,260 | 5/1977 | Walker . | |
| D. 272,807 | 2/1984 | Ruhl . | |
| 414,702 | 11/1889 | Grimm | 220/255 X |
| 1,745,456 | 2/1930 | Shuler | 222/487 X |
| 2,753,051 | 7/1956 | Tupper . | |
| 2,833,447 | 5/1958 | Thiele | 222/556 X |
| 2,986,309 | 5/1961 | Larson . | |
| 3,018,024 | 1/1962 | Foord . | |
| 3,155,285 | 11/1964 | Van Baarn . | |
| 3,283,964 | 11/1966 | Anderson | 222/487 |
| 3,322,308 | 5/1967 | Foster . | |
| 3,469,732 | 9/1969 | Foster . | |
| 3,542,235 | 11/1970 | Hidding . | |
| 3,614,136 | 10/1971 | Dent | 220/255 X |
| 3,744,662 | 7/1973 | Zundel . | |
| 4,132,225 | 1/1979 | Whattam . | |
| 4,262,802 | 4/1981 | Laauwe . | |
| 4,284,200 | 8/1981 | Bush . | |
| 4,327,842 | 5/1982 | Walter . | |
| 4,328,906 | 5/1982 | Walter . | |
| 4,462,504 | 7/1984 | Roth et al. . | |

*Primary Examiner*—Charles A. Marmor

[57] ABSTRACT

A dual orifice dispensing closure comprises a body with first and second orifices therein, the orifices being of different sizes. Lid members are hinged to the body such that plugs on the lids may be selectively positioned in or removed from orifices in the closure. A hook-shaped tab provides an interengagement between the lid members so that raising the lid member to uncover the larger of the plugged orifices will at the same time lift the other lid member which has a plug closing the smaller orifice. Accordingly, both orifices are open so that the smaller orifice can providing a venting function upon dispensing of liquid from the larger orifice.

4 Claims, 3 Drawing Sheets

MULTI-ORIFICE DISPENSING CLOSURE

BACKGROUND OF THE INVENTION

This invention relates generally to dispensing, and more particularly to a multi-orifice dispensing closure.

Multi-orifice dispensing closures are generally known. These containers frequently have two orifices of different sizes to enable the user to dispense the product within the container at different rates of flow. Where liquids are involved, closure venting is seldom incorporated into the closure design. When incorporated, venting has been accomplished, generally, by having a separate and independent venting and pour out orifices plugs. For example, there may be a plug for the primary opening through which the product is dispensed, and a secondary opening of much smaller size which can be opened to vent the container during the pouring operation. In any case, the smaller vent opening must be separately unplugged to achieve the venting function. Sometimes the user may forget to unplug the vent orifice, and this may result in spillage of the dispensed product when poured through the primary or major orifice.

OBJECTS AND SUMMARY OF THE INVENTION

An object of this invention is to provide a multi-orifice dispensing closure which forms part of or may be applied to a container and wherein a primary orifice may be opened to dispense the product from within the container while at the same time a smaller secondary orifice is opened to vent the container during the dispensing operation.

A further object of this invention is to provide a closure of the type stated having orifices therein, for example two orifices of different sizes so that the secondary or smaller orifice may also be used for dispensing if desired.

Another object of this invention is to provide a closure of the type stated in which the orifices are provided with lips to reduce the possibility of dripping if liquid product is being dispensed from the container.

In accordance with the foregoing objects the multi-orifice dispensing closure comprises a body, first and second dispensing orifices formed in said body, the first one of said orifices being substantially larger than the second orifice, a first actuable lid member independently connected to said body along a first hinge line for moving the same to an open position, said first lid member including a first closure element positionable across said first orifice to close the same in the closed position of the first lid member, a second actuable lid member independently connected to said body along a second hinge line for moving the same to an open position, said second hinge line and said first mentioned hinge line being disposed such that said second lid member is actuable to open and close said second orifice without interference with said first lid member when the latter is in the closed position, said second lid member including a second closure element positionable across the second said orifice to close the same in the closed position of the second lid member, and means connected to said first lid member and operatively associated in engaging relation with said second lid member such that actuation of said first lid member to move said first closure element from said first orifice to open the latter also causes said second lid member to be actuated to the open position thereof thereby to remove said second closure element from said second orifice to open the latter and provide a venting function.

In accordance with the invention the aforesaid means connected to said first lid member and operatively associated with the second lid member comprises a tab on the first lid member that underlies the second lid member when the lid members are closed whereby the second lid member is actuated by the first lid member. Moreover, the second lid member is movable to and from its closed and opened positions without interference from the first lid member.

DETAILED DESCRIPTION

Figure 1:
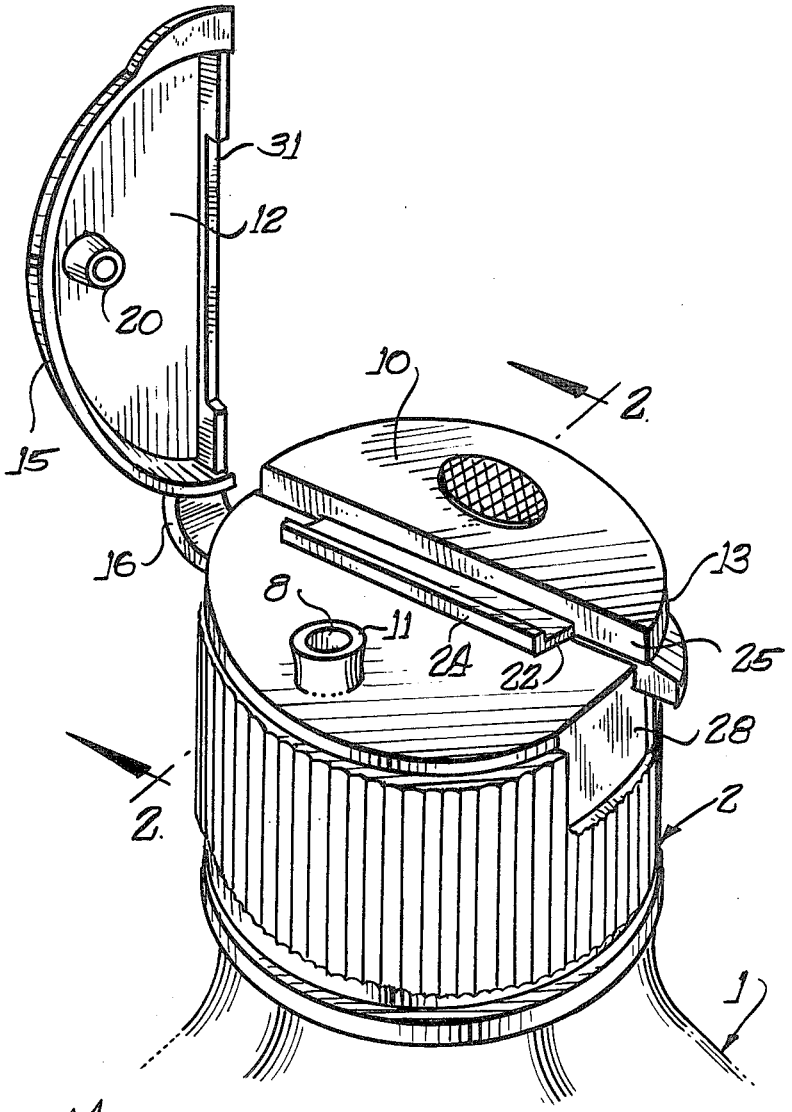
FIG. 1 is a perspective view of a multi-orifice closure constructed in accordance with an embodiment of the present invention, the lid member for the smaller orifice seen shown in the open position.
Figure 3:
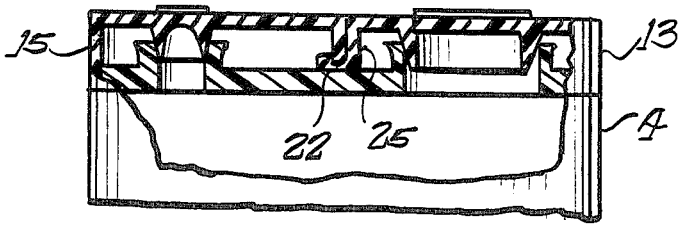
FIG. 3 is a partial sectional view but with both lids in their closed positions.

Referring now in more detail to the drawings there is shown a can or other container 1 which may be of cylindrical or other form and which has a closure 2 constituting and end wall of the container. The container with its end wall may be formed of a single piece of plastic of any suitable resin, as for example polyolefin resin. The closure 2 may, however, be initially a separate member sealed or otherwise secured to the remainder of the container as by a conventional seal such as a linerless seal and/or a screw thread 5. Thus, the closure 2 has a body 4 which forms a sealing means having first and second dispensing orifices 6, 8. The first of said orifices 6 is substantially larger than the second orifice 8, and surrounding the orifices 6, 8 are anti-drip pour lips 9, 11.

A first actuatable lid member 10 is independently connected to the body 4 along a first member 14 forming a hinge line and a second actuatable lid member 12 is independently connected to a second member 16 forming another hinge line. In one of the embodiments of the invention disclosed, the members 14, 16 are formed of a short strap or like lengths of material, and the members are adjacent to each other such that the hinge lines are substantially in spaced parallel relation or coincide. It will be understood however that the lid members 10, 12 may be attached to the container in other ways, for example by an ordinary pin-pivot hinge connections.

Each of the lid members 10, 12 is substantially a fraction of a circle. The lid member 10 has a semicylindrical flange 13 while the lid member 12 has a similar flange 15. Furthermore, the lid member 10 has a diametral flange 25 from which projects a tab 22 constituting on L-shaped hook with an upstanding ridge 24. The L-shaped hook fits in a central notch 31 in the diametral flange 26 when the lid members are closed. In the closed position plug 20 on the underside of the lid member 12 sealingly closes the orifice 8 while a plug 18 sealingly closes the orifice 6. The cylindrical side wall 29 of the container 1 may be molded or otherwise formed with an indentation 28 which facilitates access to the undersides of the flanges 13, 15 for raising the lid members to their open positions.

Figure 4:
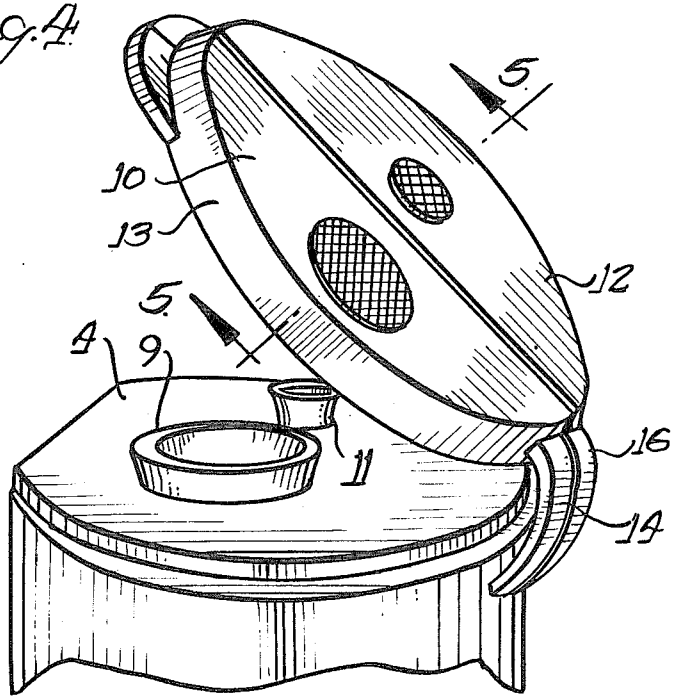
FIG. 4 is another perspective view of the container showing the novel dispensing closure and with both lid members shown in their open positions.
Figure 5:
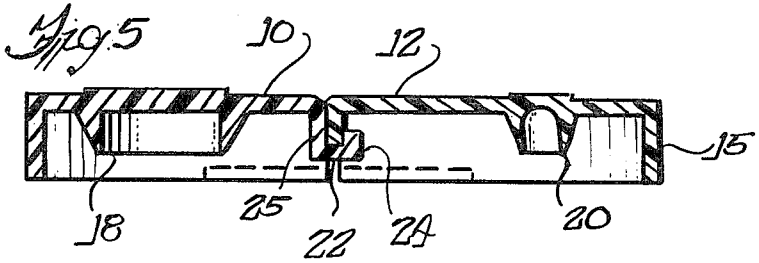
FIG. 5 is a partial sectional view taken along line 5—5 of FIG. 4.
Figure 2:
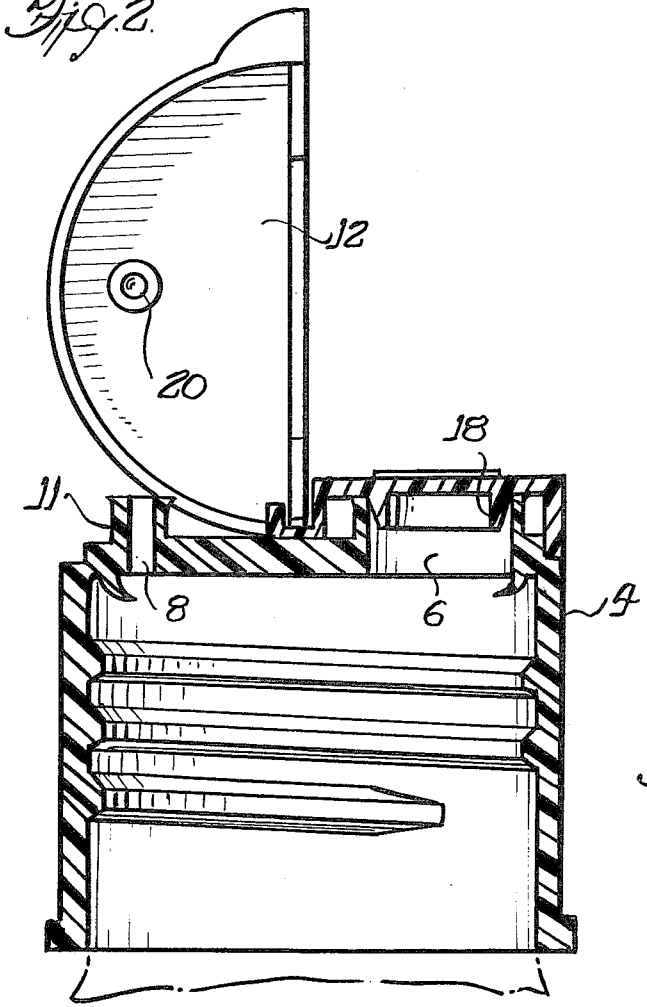
FIG. 2 is a fragmentary sectional view taken along line 2—2 of FIG. 1.

As best seen in FIG. 4, the top surfaces of the lid members 10, 12 may be engraved or embossed to show the relative sizes and shapes of the orifices 6, 8.

When the lid members 10, 12 are in their closed positions the plug 20 seats into and seals the orifice 8. At the same time the larger orifice 6 is sealed by the plug 18. When opening of the orifice 8 is desired for dispensing the flange 15 may be gripped in the region of the indentation 28, whereupon the lid member 12 is lifted upwardly to the position shown in FIG. 1.

If access to the larger orifice 6 is desired and both lid members are closed, lid member 10 is lifted from the closed position to the position shown in FIG. 4. When the lid member 10 is lifted not only does the plug 18 become removed from the orifice 6 but the tab 22 pulls on the lid member 12 to raise it and unplug the orifice 8 and thereby provide a venting function.

Figure 6:
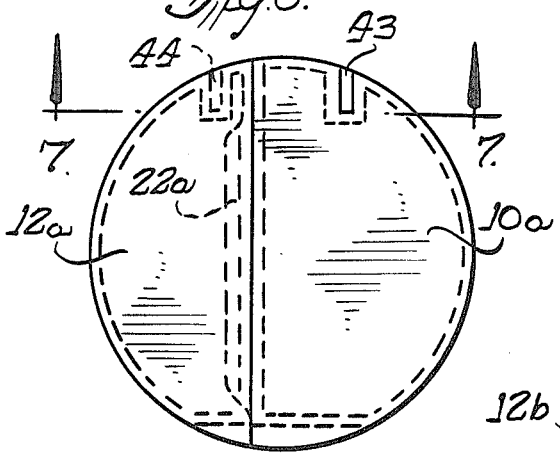
FIG. 6 is a top plan view of a closure in accordance with a further embodiment of the present invention.
Figure 7:
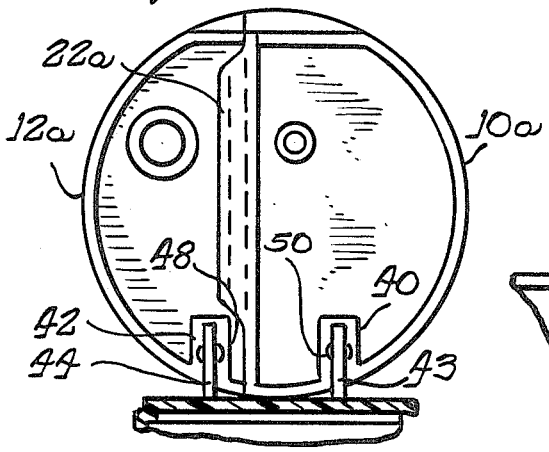
FIG. 7 is a fragmentary sectional view taken along line 7—7 of FIG. 6 but showing both lid members in the open position.

In FIGS. 6 and 7 there is shown a modification of the present invention. In this form of the invention the lid members **10*a*, 12*a* are each molded with a U-shaped wall 40, 42 that define slots for receiving upstanding pivot posts 43, 44 which are parallel to each other and are located in spaced apart relationship on the wall of the closure body 4. The pivot posts 43, 44 have lateral protuberances 48, 50 which fit into adjacent shallow recesses on the respective walls 40, 42. The protuberances 48, 50 are in axial alignment and define coaxial hinge axes for the lid members 10*a*, 12*a*. The arrangement is such that each lid member 10*a*, 12*a* may be snapped into place by reason of the yielding of the plastic of the wall 40, 42 and/or the protuberances 48, 50. In any event, the lid member 10*a* has a tab 22*a* which constitutes an L-shaped hook that fits into a notch on the lid member 12*a* much as in the manner shown in FIGS. 1–5. Thus, when the lid member 10 is lifted upwardly to uncover the large opening, the lid member 12*a*** is pulled upwardly so as to open the smaller venting hole.

Figure 8:
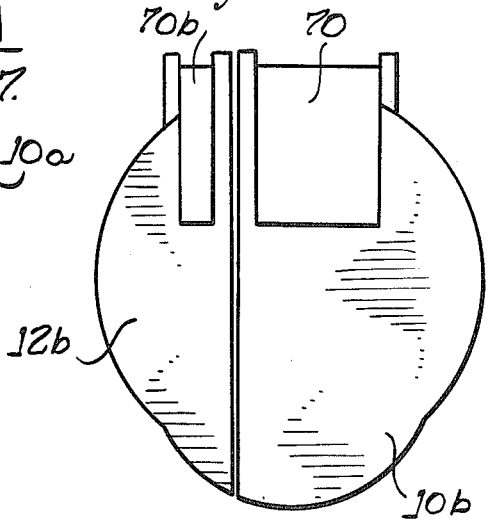
FIG. 8 is a top plan view of a further modification of the present invention.
Figure 10:
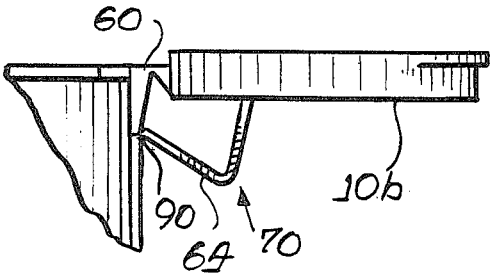
FIG. 10 is a side elevational view of the closure of FIG. 9 in the open position and mounted upon a container.
Figure 9:
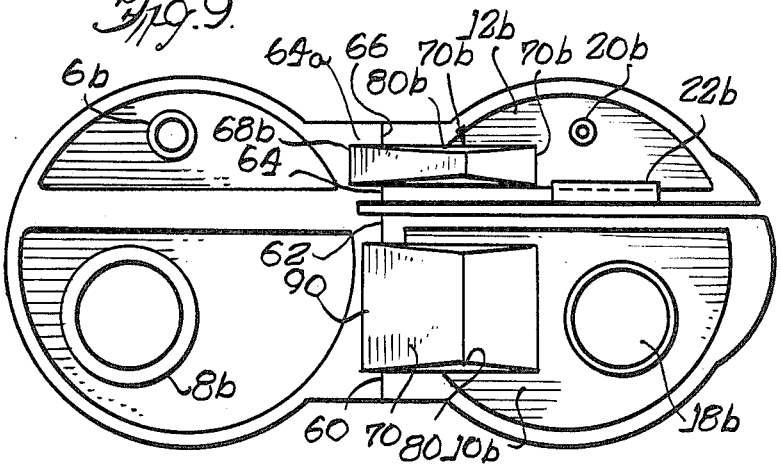
FIG. 9 is a plan view showing the closure of FIG. 8 in the open position.

FIGS. 8–10 show a further modification of the invention. The closure body has first and second dispensing orifices **6*b*, 8*b* which are adapted to be closed off by plugs 18*b*, 20*b* which are molded to the underside of the lid members 10*b*, 12*b*. Each lid member 10*b* or 12*b* is secured to the remainder of the closure body along hinge lines 60, 62, 64, 66 which are such that the hinge axis for the two lid members 10*b*, 12*b* are substantially coaxial. Joining the body of the closure to one of the lid members 10*b* is an articulated spring 70 the free ends of which are joined respectively to the closure body at 68 and at 90 to the lid member 10*b*. A like articulated spring 70*b*, though shorter in width, joins the lid member 12*b* and the closure body along hinge line 68*b*, 70*b*. Furthermore, in the region of each hinge arm 70, 70*b* the structure is cut away to provide openings 80, 80*b***.

The inside of the lid member **10*b* has an L-shaped hook 22*b* which, when the lids 10*b*, 12*b* are closed fits into a central notch in the manner of FIGS. 1–5. Accordingly, the L-shaped hook serves to pull the lid member 12*b* open when the lid member 10*b*** is shifted from the closed position to the open position.

The articulated spring members **70, 70*b*** respectively serve to apply spring force to the associated lid member to open or close the same, as the case may be. For instance, as the lid member is moved from a closed position to an open position there will be some resistance by the spring. However, as the spring passes "dead center" its action will tend to force the lid member to the open position. Likewise, in closing the lid member movement past dead center will cause the spring to force the lid to its closed position.

The invention is claimed as follows:

1. A multi-orifice dispensing closure comprising a body having a chamber with an end wall thereacross, first and second spaced apart dispensing orifices formed in the end wall of said body and each exposed to said chamber, the first one of said orifices being substantially larger than the second orifice, a first actuatable lid member independently connected to said body along a first hinge line for movement of the same between an open position and a closed position extending over at least that portion of the end wall with the included first orifice, said first lid member including a first closure element positionable across said first orifice to close the same in the closed position of said first lid member, a second actuatable lid member independently connected to said body along a second hinge line for movement of the same between an open position and a closed position extending over at least that portion of the end wall with the included second orifice, said second hinge line and said first mentioned hinge line being disposed such that said second lid member is actuatable to open and close said second orifice without interference with said first lid member when the latter is in the closed position but not in the open position, said second lid member including a second closure element positionable across the second said orifice to close the same in the closed position of said second lid member, each lid member including a depending flange disposed in side-by-side adjacency when both lid members are in closed positions, the flange of said first lid member including a lateral tab extension to underlie the second lid member when both lid members are in closed positions, and the flange of the second lid member having an notch at the free end thereof dimensioned for the tab extension to fit therein when both lid members are in closed positions to provide a selectively releasable abutting relationship therebetween such that actuation of said first lid member to remove said first closure element from said first orifice to open the latter also causes said second lid member to be actuated to the open position thereof through the abutting relationship between the tab extension and the notch surface thereby to remove said second closure element from said second orifice to open the latter and provide a venting function to said chamber, the releasable abutting relationship between the tab extension and the notch permitting said first lid member to be operated to open and close said first orifice independently of said second lid member when the latter is in an open position.

2. A multi-orifice dispensing closure according to claim 1 in which the first and second hinge lines are in spaced parallel relationship.

3. A multi-orifice dispensing closure according to claim 1 in which the tab extension terminates in an upstanding edge portion forming therewith an L-shape within which the depending flange of the second lid member and the included notch fit when both lid members are in closed positions.

4. A multi-orifice dispensing closure according to claim 3 in which the tab extension and upstanding edge portion are elongate along the depending flange of the first lid member and the notch on the flange of the second lid member is similarly elongated therealong for interfitting with the tab extension and the edge portion when both lid members are in closed positions.

* * * * *